US010533358B2

(12) United States Patent
Naganuma

(10) Patent No.: US 10,533,358 B2
(45) Date of Patent: Jan. 14, 2020

(54) HINGE

(71) Applicant: Sugatsune Kogyo Co., Ltd., Tokyo (JP)

(72) Inventor: Kenta Naganuma, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 0 days.

(21) Appl. No.: 15/762,955

(22) PCT Filed: Aug. 31, 2016

(86) PCT No.: PCT/JP2016/075391
§ 371 (c)(1),
(2) Date: Mar. 23, 2018

(87) PCT Pub. No.: WO2017/051673
PCT Pub. Date: Mar. 30, 2017

(65) Prior Publication Data
US 2018/0274274 A1 Sep. 27, 2018

(30) Foreign Application Priority Data
Sep. 24, 2015 (JP) ..... 2015-186354

(51) Int. Cl.
*E05D 11/08* (2006.01)
*E05D 11/10* (2006.01)
*E05D 3/02* (2006.01)

(52) U.S. Cl.
CPC ..... *E05D 11/087* (2013.01); *E05D 11/084* (2013.01); *E05D 11/1028* (2013.01); *E05D 3/02* (2013.01); *E05Y 2201/21* (2013.01)

(58) Field of Classification Search
CPC ... E05D 11/082; E05D 11/084; E05D 11/087; E05D 11/1028; F16C 11/103; F16C 11/045
(Continued)

(56) References Cited

U.S. PATENT DOCUMENTS 325,493 A * 9/1885 Breithut ..... E05D 11/082 16/338
383,468 A * 5/1888 Jones ..... E05D 11/082 16/338
(Continued)

FOREIGN PATENT DOCUMENTS

CN 1890472 A 1/2007
JP H10-26128 A 1/1998
(Continued)

OTHER PUBLICATIONS

ISA/JP, International Search Report dated Nov. 29, 2016 in International Application No. PCT/JP2016/075391, 2 pages with English translation.
(Continued)

*Primary Examiner* — Jeffrey O'Brien
(74) *Attorney, Agent, or Firm* — Masuvalley & Partners

(57) ABSTRACT

Provided is a hinge which can be easily assembled. A shaft-side friction generation member is non-rotatably provided to the shaft member of a hinge, and a cylinder-side friction generation member is relatively rotatably provided to the shaft member of the hinge. The cylinder-side friction generation section of the cylinder-side friction generation member is accommodated within a first cylinder section. A connection protrusion protrudes radially outward from the cylinder-side friction generation section. The connection protrusion protrudes further radially outward than the first cylinder section and is affixed to a mounting section.

4 Claims, 12 Drawing Sheets

(58) Field of Classification Search
USPC ..... 16/337, 338, 339, 340, 341, 342
See application file for complete search history.

(56) References Cited

U.S. PATENT DOCUMENTS 608,459 A * 8/1898 Judson ..... E05D 11/082 16/338
684,074 A * 10/1901 Luppert ..... E05D 11/082 16/342
1,610,404 A * 12/1926 Winfrey ..... E05D 11/081 16/339
4,986,507 A * 1/1991 Chiang ..... F16M 11/10 16/342
5,075,929 A * 12/1991 Chung ..... G06F 1/1616 16/337
5,081,742 A * 1/1992 Kobayashi ..... G06F 1/1616 16/337
5,406,678 A * 4/1995 Kaden ..... G06F 1/1616 16/342
5,522,666 A * 6/1996 Tanaka ..... E05D 11/082 384/125
6,085,388 A * 7/2000 Kaneko ..... G06F 1/1616 16/274
7,380,312 B2 * 6/2008 Ge ..... H04M 1/0216 16/342
7,451,523 B2 * 11/2008 Chen ..... G06F 1/1616 16/342
7,520,025 B2 * 4/2009 Hung ..... G06F 1/1632 16/337
7,533,448 B2 * 5/2009 Chern ..... G06F 1/1616 16/342
7,584,524 B2 * 9/2009 Hung ..... G06F 1/1632 16/319
7,607,202 B1 * 10/2009 Lee ..... G06F 1/1616 16/342
7,690,084 B2 * 4/2010 Lu ..... G06F 1/1616 16/382
8,091,179 B2 * 1/2012 Wang ..... G06F 1/1616 16/338
9,206,633 B1 * 12/2015 Ju ..... G06F 1/1681
10,175,730 B2 * 1/2019 Lin ..... E05D 3/04
2004/0025298 A1 * 2/2004 Yang ..... E05D 11/087 16/340
2007/0136996 A1 * 6/2007 Chen ..... G06F 1/1616 16/342
2007/0212162 A1 * 9/2007 Schank ..... F16C 11/103 403/2
2008/0010779 A1 * 1/2008 Chen ..... G06F 1/1616 16/339
2009/0025180 A1 * 1/2009 Hsu ..... G06F 1/1616 16/239
2009/0144936 A1 * 6/2009 Chern ..... G06F 1/1616 16/337
2009/0293229 A1 * 12/2009 Chiang ..... G06F 1/1616 16/342
2010/0139040 A1 * 6/2010 Shen ..... G06F 1/1616 16/250
2010/0281653 A1 * 11/2010 Lin ..... G06F 1/1616 16/285
2011/0232032 A1 * 9/2011 Chu ..... G06F 1/1681 16/221
2014/0310915 A1 * 10/2014 Tung ..... E05D 11/082 16/342
2014/0331452 A1 * 11/2014 Zhang ..... G06F 1/1681 16/337
2015/0309539 A1 * 10/2015 Kamphuis ..... G06F 1/1681 361/679.27

FOREIGN PATENT DOCUMENTS

JP 4594135 B2 12/2010
JP 2011-58607 A 3/2011
TW 155432 4/1991
WO 2007/023672 A1 3/2007

OTHER PUBLICATIONS

Taiwan Patent Office/ Office Action dated Dec. 6, 2017 for Taiwan Patent Application No. 105129593, 7 pages including English translation.

* cited by examiner

HINGE

RELATED APPLICATIONS

This application is the U.S. National Phase of and claims priority to International Patent Application No. PCT/JP2016/075391, International Filing Date Aug. 31, 2016, which claims benefit of Japanese Patent Application No. 2015-186354 filed Sep. 24, 2015; both of which are incorporated herein by reference in their entireties.

TECHNICAL FIELD

The present invention relates to a hinge which rotatably couples a first member and a second member, and in particular relates to a torque hinge which can hold the second member with respect to the first member at an arbitral rotation angle by generating rotational resistance due to friction during rotation.

BACKGROUND ART

In general, a rotational body such as a door or a rotational cover or the like is rotatably provided on a housing or a main body through a hinge. There is a case that it is requested that the rotational body is to be kept at an arbitral angle. A torque hinge is used to respond to such a request, and it is configured so that when the rotational body is rotated, rotational resistance due to friction is caused.

For example, a torque hinge described in Patent Document 1: JP 4594135B includes two wing-shaped mounting members, a shaft member and two friction generating members. In each of the mounting members, a cylindrical portion is integrally provided. The cylindrical portions of the two mounting members are arranged along the same axial line, and the shaft member is inserted into the insides of these cylindrical portions. One end portion of the shaft member is fixed to the cylindrical portion of one of the mounting members. Both of the two friction generating members are formed into substantially annular shapes, and the shaft member is inserted into central holes and received in the cylindrical portion of the other mounting member. A shaft side friction generating member of the two friction generating members is rotated together with the shaft member. A cylindrical side friction generating member is rotated together with the other mounting member. The two friction generating members are pressure-contact with each other by mean of biasing force of a disk-shaped spring. Due to this pressure-contact, friction is caused between the friction generating members when the two mounting members are relatively rotated. With this friction, it is possible to keep a rotational body such as a door with respect to a main body at an arbitral relative rotational angle.

A cutout portion is formed at one position of a circumferential direction of the cylindrical portion of the other mounting member. In the cylindrical side friction generating member, a convex portion is formed so as to protrude radially and outwardly. This convex portion is fitted into the cutout portion. The width of the cutout portion is substantially the same as the width of the convex portion, and opposite end surfaces of the convex portion in a width direction are respectively in contact with opposite end surfaces of the cutout portion in the width direction. In this way, torque can be transmitted between the other mounting member and the cylindrical side friction generating member without play.

SUMMARY OF THE INVENTION

In the conventional hinge of this type described in the Patent Document mentioned above, it was necessary to strictly coincide the angle of the convex portion of the cylindrical side friction generating member with the angle of the cutout portion of the cylindrical portion preciously when assembled, and in this state, at the same time of fitting the convex portion into the cutout portion, the shaft member was inserted into the central holes of the friction generating member, thus assembly was very troublesome.

The present invention has been made in view of the above situation, and it is an object thereof to provide a hinge which can be easily assembled.

In order to solve the problem mentioned above, the present invention is directed to a hinge for rotatably coupling a second member with respect to a first member around an axial line thereof, which is characterized by comprising:

a shaft member to be coupled with one of the first and second members;

a mounting member which includes a cylindrical portion provided coaxially with the shaft member and a mounting portion which protrudes from the cylindrical portion radially and outwardly so as to be fixed to the other of the first and second members;

a shaft side friction generating member which is provided on the shaft member so as not to be rotatable; and a cylindrical side friction generating member which includes a cylindrical side friction generating portion provided on the shaft member in a relatively rotatable manner and a coupling protruding portion which protrudes from the cylindrical side friction generating portion radially and outwardly, wherein the shaft side friction generating member and the cylindrical side friction generating portion are contained in the cylindrical portion in such a state that they are pressure-contact with each other together with a part of the shaft member, and wherein the coupling protruding portion protrudes from the cylindrical portion radially and outwardly and is fixed with the mounting portion.

According to this hinge, it is sufficient that the coupling protruding portion is fixed with the mounting portion on the radially outside of the cylindrical portion, and thus assemble thereof can be made easily. Due to the fixing of the coupling protruding portion and the mounting portion, the cylindrical side friction generating member and the cylindrical portion are rotated together. Further, friction resistance is caused by the pressure-contact between the shaft side friction generating member and the cylindrical side friction generating member. Thereby, it becomes possible to keep the second member with respect to the first member at the arbitral angle.

It is preferred that at a side part of the cylindrical portion in a circumferential direction thereof, there is formed a cut out portion into and from which the coupling protruding portion can be inserted and removed in a direction along with the axial line. In this way, a clearance can be formed between the coupling protruding portion and the cutout portion. Further, it is also possible to enlarge the width of the cutout portion than a width of a part of the coupling protruding portion which is to be inserted into the cutout portion. Therefore, it becomes possible to easily insert the coupling protruding portion into the cutout portion. It is not necessary to preciously make angular-positioning of the coupling protruding portion with respect to the cutout portion. Thereafter, the coupling protruding portion is fixed to the mounting portion located outside the cutout portion. Thereby, assemble thereof can be made easier.

It is preferred that the mounting portion is formed with a fitting recess which is continuous to the cutout portion so as to extend toward a radial direction, and when the cylindrical side friction generating portion is relatively rotated with respect to the cylindrical portion in the contained state in the cylindrical portion, the coupling protruding portion can be inserted and removed into and from the fitting recess. After the coupling protruding portion is inserted into the cutout portion so that the cylindrical side friction generating portion is received in the cylindrical portion, the cylindrical side friction generating member is relatively rotated with respect to the cylindrical portion, thereby enabling the coupling protruding portion to be fitted into the fitting recess. In this way, it is possible to regulate displacement of the coupling protruding portion in the axial direction and thereby to prevent the cylindrical side friction generating member from being removed from the cylindrical portion. Further, it is also possible to position the cylindrical side friction generating portion with respect to the cylindrical portion in the axial direction as well as the circumferential direction so that assembling preciousness can be increased and fixing operation between the coupling protruding portion and the mounting portion can be made easily.

It is preferred that a receiving recessed portion is formed in a surface of the mounting portion which is to be abutment with the other of the first and second members, and the fitting recess is formed in the receiving recessed portion, wherein the coupling protruding portion includes a protruding plate portion which protrudes from the cylindrical side friction generating portion radially and outwardly, and a fixed plate portion which protrudes from the protruding plate portion along with the axial line, and wherein the protruding plate portion is received into the fitting recess, and the fixed plate portion is received into the receiving recessed portion and fixed to the mounting portion.

In this way, it is possible to make the fixing operation of the coupling protruding portion easier. Further, it is also possible to receive the coupling protruding portion in the inside of the mounting portion, and thus aesthetic appearance of the hinge can be secured.

It is preferred that the hinge comprises a fixing member for fixing the coupling protruding portion and the mounting portion.

In this way, it is possible to fix the cylindrical side friction generating member to the mounting portion reliably. By doing so, a sufficient play or clearance can be formed between the coupling protruding portion of the cylindrical side friction generating member and the cutout portion, thus assembling operation can be made easier.

According to the present invention, it is possible to assemble a hinge easily.

BRIEF DESCRIPTION OF THE DRAWINGS

FIG. 11A-FIG. 11B shows a process of assembling the hinge, in which FIG. 11A is a perspective view which shows a state that the second mounting member including a shaft member and a friction generating means faces the first mounting member with each other. FIG. 11B is a perspective view which shows a state that the shaft member and the friction generating means attached to the second mounting member are inserted into the cylindrical portion of the first mounting member.

Hereinafter, embodiments of the present invention will be described with reference to the accompanying drawings.

Figure 12A:
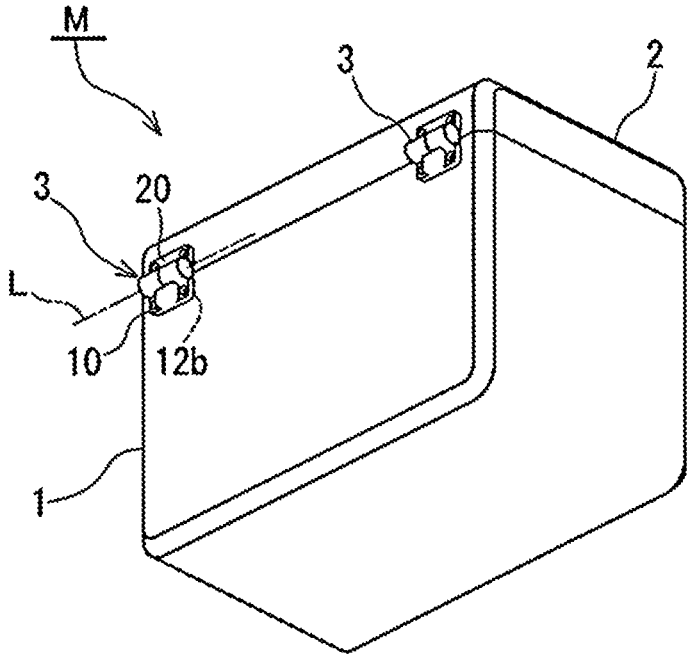
FIG. 12A is a perspective view which shows a state that a rotational cover of the container apparatus equipped with the hinge is closed.
Figure 12B:
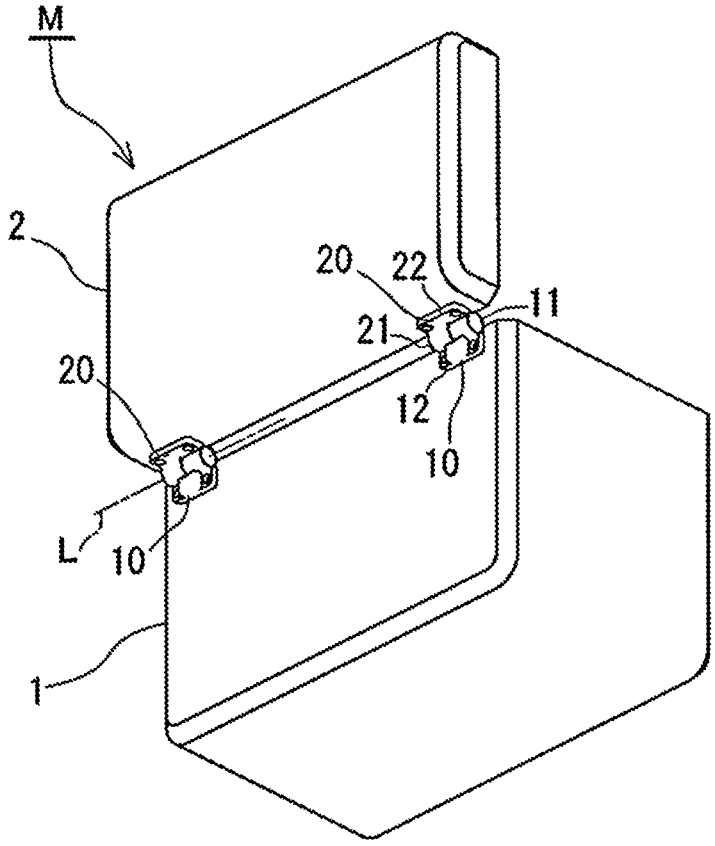
FIG. 12B is a perspective view which shows a state that the rotational cover of the container apparatus is opened.

As shown in FIG. 12A and FIG. 12B, a container apparatus M includes a housing 1 (a first member), a rotational cover 2 (a second member, a rotational body) and a torque hinge 3 (a hinge). An upper surface of the housing 1 is opened, and the rotational cover 2 is provided therein. The torque hinge 3 is arranged so as to straddle between the housing 1 and the rotational cover 2. The rotational cover 2 is rotatably connected through the torque hinge 3 around an axis line L that is horizontal to the housing 1. By the rotation of the rotational cover 2, the container apparatus M is opened and closed. In addition, by the function of the torque hinge 3, the rotational cover 2 is held at an arbitrary rotation angle with respect to the housing 1.

Figure 3:
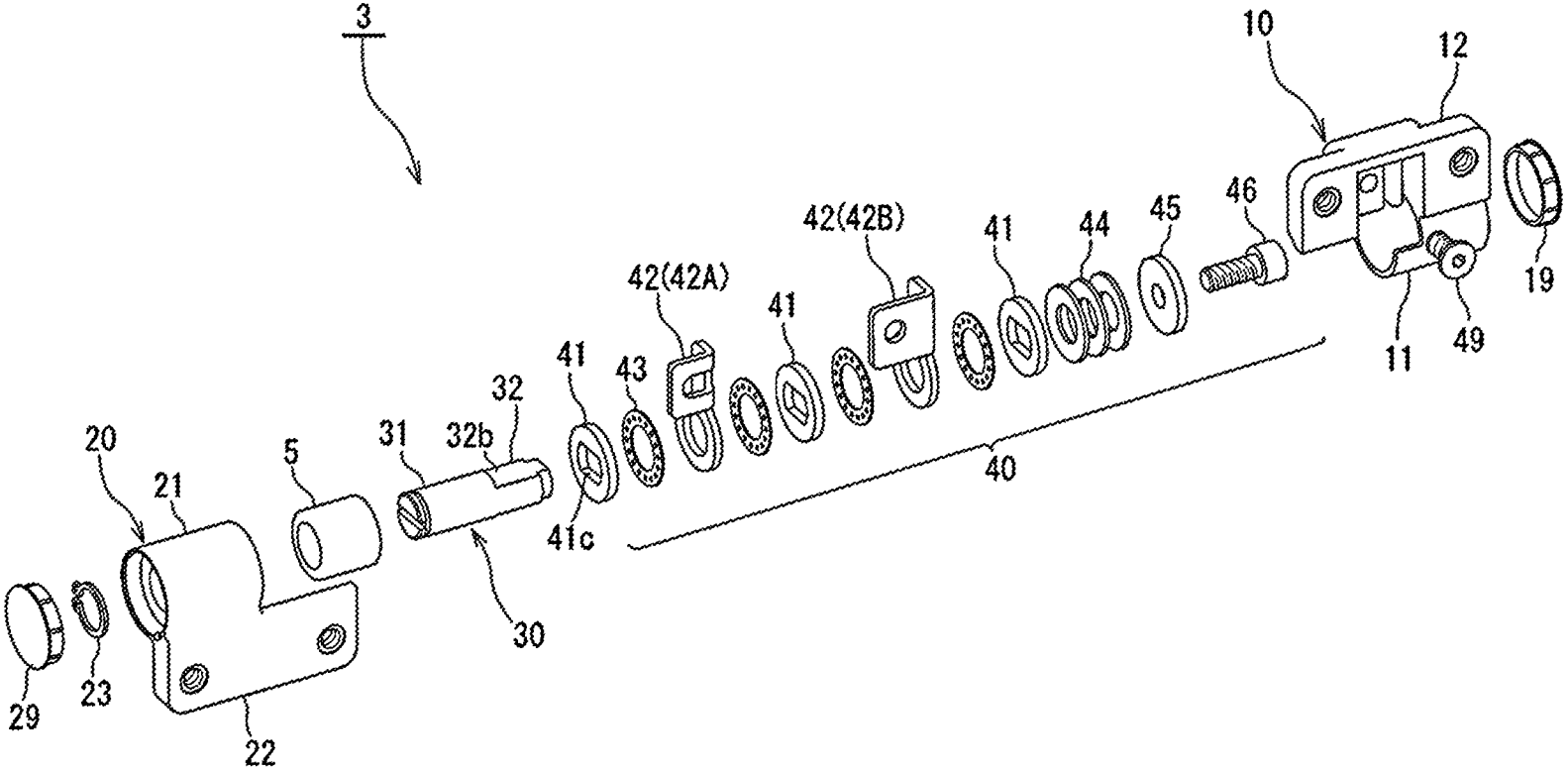
FIG. 3 is an exploded perspective view of the hinge.

As shown in FIG. 3, the torque hinge 3 includes two mounting members 10, 20, a shaft member 30 and a friction generating means 40.

As shown in FIG. 1A through FIG. 2D, a first mounting member 10 (mounting member) includes a first cylindrical portion 11 (cylindrical portion) and a first mounting portion 12 (mounting portion). The first cylindrical portion 11 becomes a cylindrical shape which is coaxial with the axis line L. Both ends of the first cylindrical portion 11 are opened, respectively. The opening on the outer side of the first cylindrical portion 11 in an axial direction (the right side in FIG. 1A) is closed by a cap 19.

The first mounting portion 12 is integrally provided on one side portion of the circumferential surface of the first cylindrical portion 11. The first mounting portion 12 is formed into a substantially flat plate shape, protrudes from the first cylindrical portion 11 radially and outwardly, and extends from the first cylindrical portion 11 toward the side of the second cylindrical portion 21 described later along with the axis line L (the left side in FIG. 1 (*a*)). As shown in FIG. 1, the first mounting portion 12 includes a cylindrical side portion 12*a* on the side of the first cylindrical portion 11 and an extending portion 12*e* extending toward the side of the second mounting member 20.

As shown in FIG. 12A and FIG. 12B, a back side surface 12*b* (FIG. 1B) of the first mounting portion 12 is abutment with the housing 1. Then, the first mounting portion 12 is fixed to the housing 1 by a fixing means such as screws.

Figure 1A:
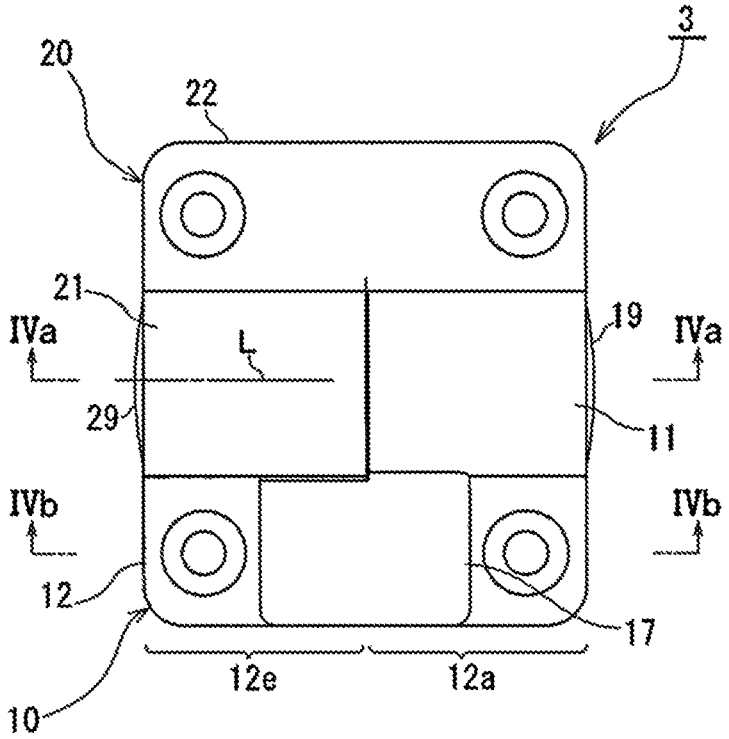
FIG. 1A is a front view of a hinge of one embodiment of the present invention, in which mounting portions of two mounting members are in a state that they form an angle of 180 degrees with each other (a closed state of a container apparatus) and it is viewed from a front side (a side appeared outside of the container apparatus).
Figure 1B:
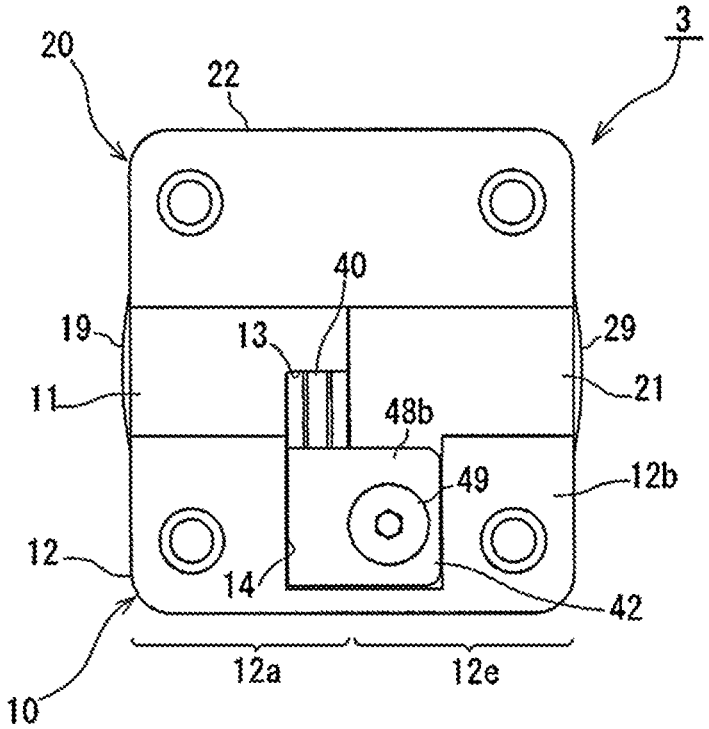
FIG. 1B is a rear view of the hinge in the state of FIG. 1A which is viewed from a back side (a side to be attached to a housing and a rotational cover of the container apparatus).

As shown in FIG. 1, the second mounting member 20 includes a second cylindrical portion 21 and a second mounting portion 22. The second cylindrical portion 21 becomes a cylindrical shape which is coaxial with the axis line L. Both ends of the second cylindrical portion 21 are opened, respectively. The opening on the outer side (the left side in FIG. 1A) of the second cylindrical portion 21 in the axial direction is closed by a cap 29.

The first cylindrical portion 11 and the second cylindrical portion 21 are arranged side by side on the same axial line L.

As shown in FIGS. 2A-2D, the second mounting portion 22 is integrally provided on one side portion of the circumferential surface of the second cylindrical portion 21. The second mounting portion 22 is formed into a substantially flat plate shape, protrudes from the second cylindrical portion 21 radially and outwardly, and extends from the second cylindrical portion 21 to the side of the first cylindrical portion 11 (the right side in FIG. 1A) along with the axis line L. As shown in FIG. 12A and FIG. 12B, the second mounting portion 22 is fixed to the rotational cover 2 by the fixing means such as screws.

Figure 7:
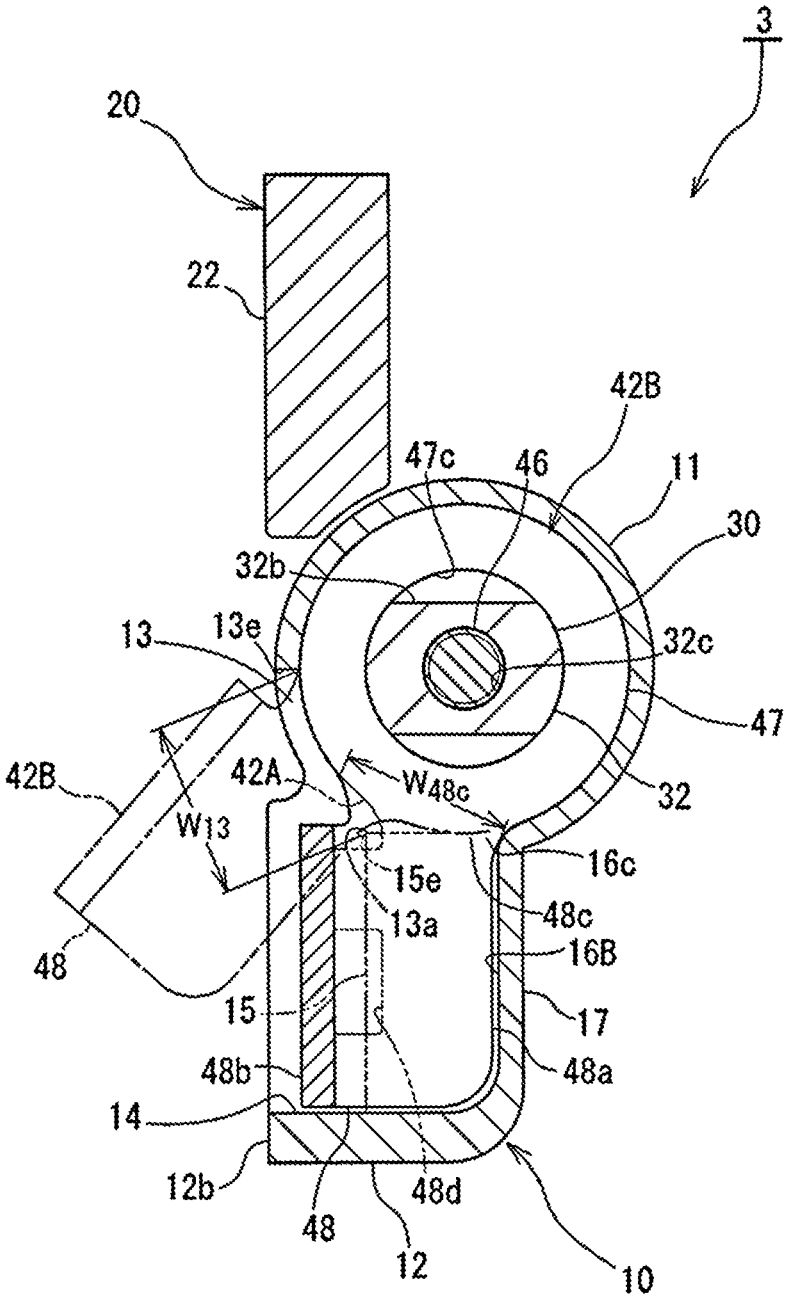
FIG. 7 is a cross-sectional view of a side surface of the hinge taken along a line VII-VII in FIG. 5.
Figure 10:
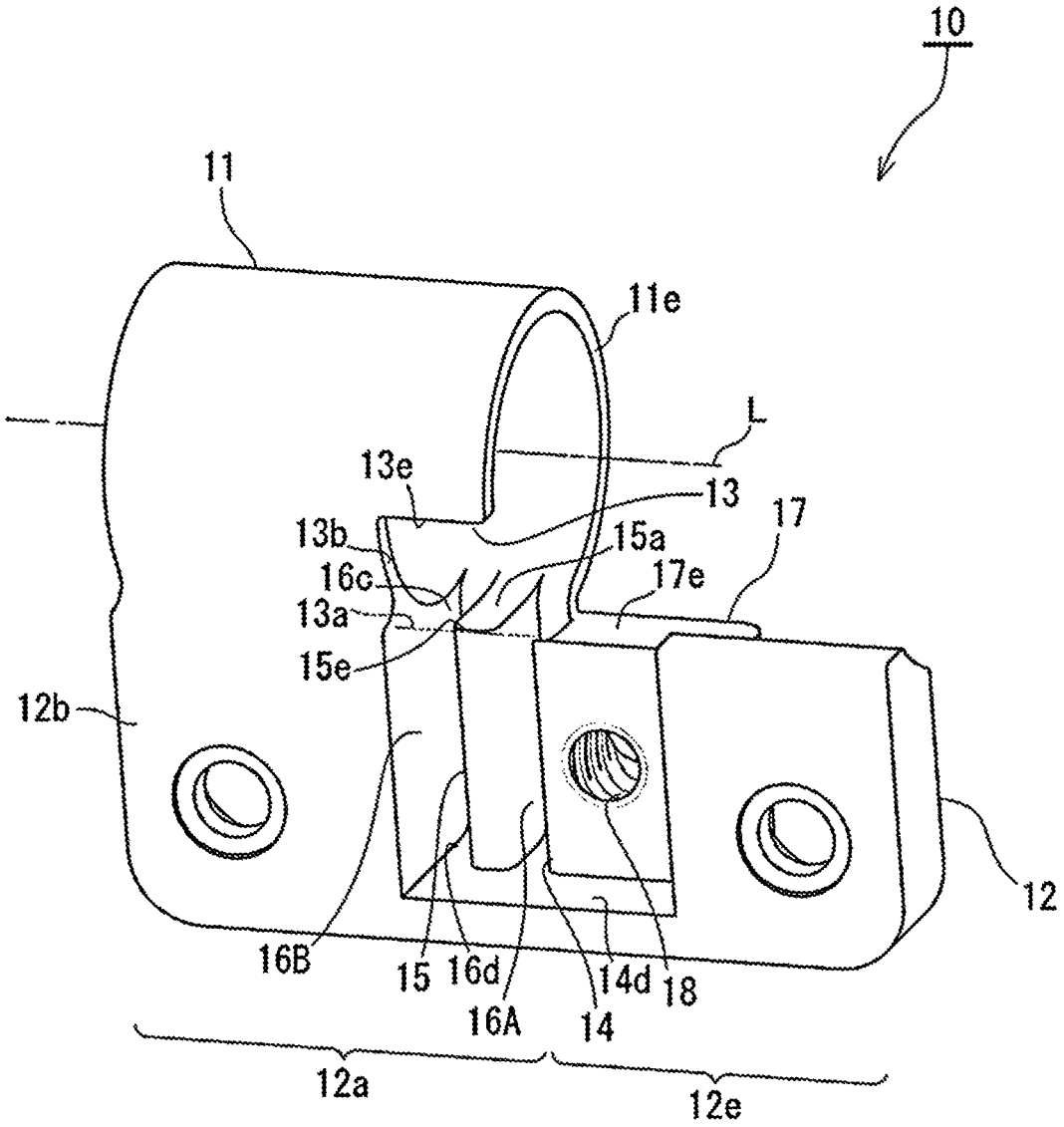
FIG. 10 is a perspective view of the first mounting member of the hinge, which is viewed from the back side thereof.

As shown in FIG. 7 and FIG. 10, a cutout portion 13 is formed on one side portion in a circumferential direction of the first cylindrical portion 11 of the first mounting member 10. The cutout portion 13 reaches an end surface 11*e* facing the side of the second cylindrical portion 21 (the right side in FIG. 10) of the first cylindrical portion 11. The width direction of the cutout portion 13 is along the circumferential direction of the first cylindrical portion 11. One end portion 13*a* (the lower end portion in FIG. 7) in the width direction of the cutout portion 13 is located in a continuous portion between the first cylindrical portion 11 and the first mounting portion 12. More specifically, one end portion 13*a* of the cutout portion 13 in the width direction is located on a virtual line parallel to the axis line L through a corner portion 15*e* described later. The other end portion 13*e* of the cutout portion 13 in the width direction (the upper end portion in FIG. 7) is located in the vicinity of the back side portion (the left side portion in FIG. 7) of the first cylindrical portion 11. The width dimension $W_{13}$ of the cutout portion 13 is, for example, about one eighth to one sixth of the circumference of the first cylindrical portion 11.

Figure 2A:
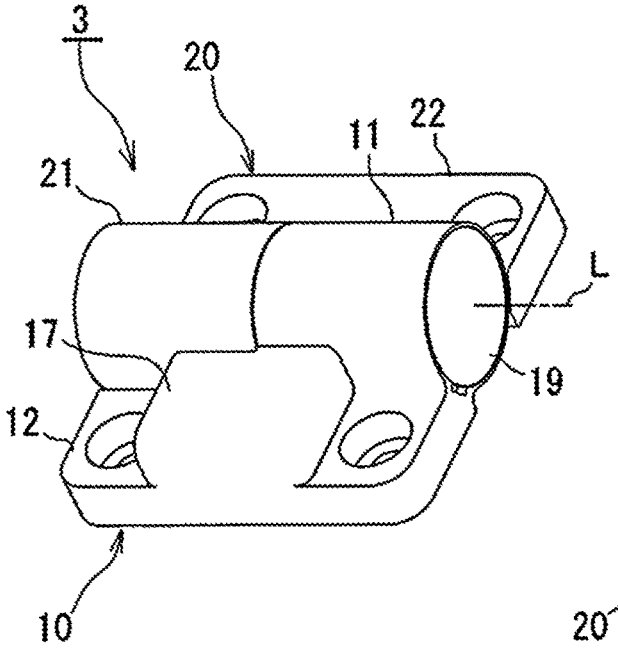
FIG. 2A is a perspective view of the hinge in the state of FIG. 1A, which is viewed from the front side.
Figure 2B:
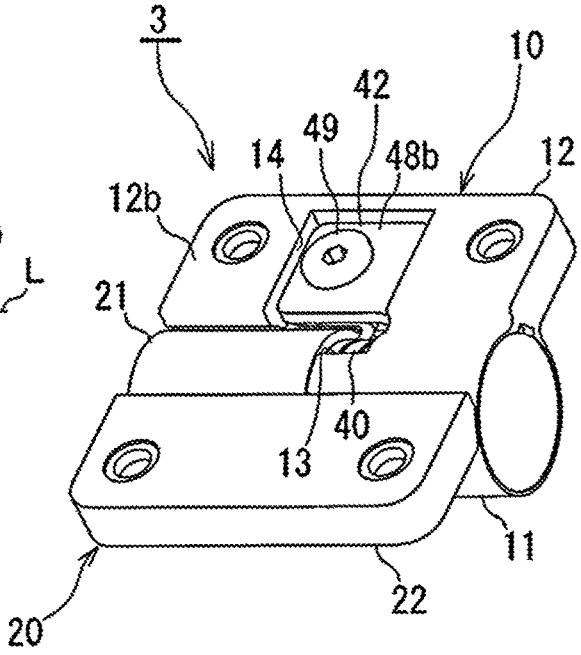
FIG. 2B is a perspective view of the hinge in the state of FIG. 1A, which is viewed from the back side.
Figure 2C:
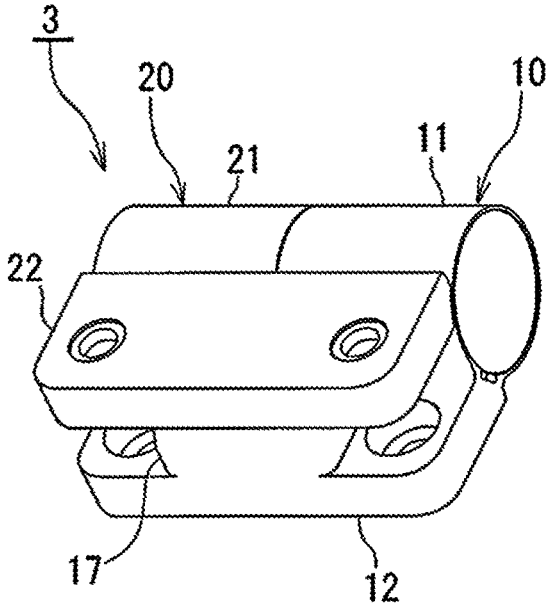
FIG. 2C is a perspective view of the hinge at an angle (a full-open state of the container apparatus) in which the mounting portions face in parallel with each other and which is viewed from the side of the second mounting member.
Figure 2D:
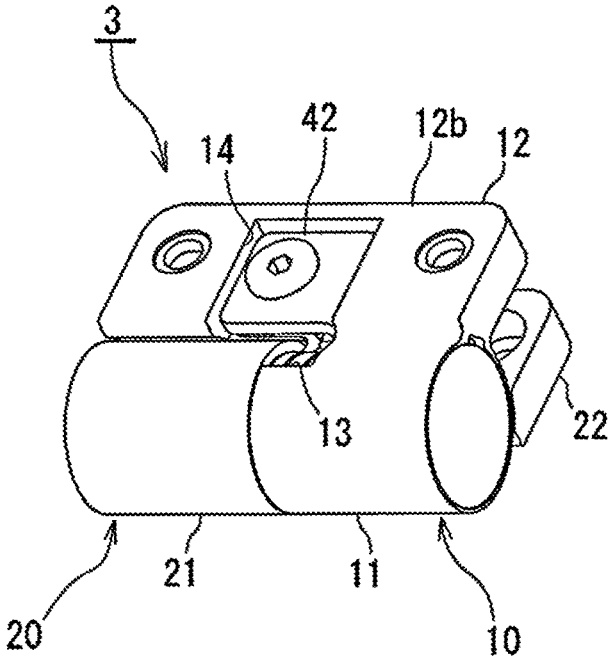
FIG. 2D is a perspective view of the hinge in the state of FIG. 2C, which is viewed from the side of the first mounting member.

As shown in FIG. 1A and FIG. 2A, a raised portion 17 is formed at a middle portion of the front side surface of the first mounting portion 12. The raised portion 17 is formed into a quadrangle shape when viewed from the front, raised from the first mounting portion 12 to the front side (the front side in the plane of the drawing in FIG. 1A), and is arranged so as to straddle from the cylindrical side portion 12*a* to the extending portion 12*e*.

As shown in FIG. 1A and FIG. 2A, a quadrangular receiving recessed portion 14 is formed at the back side surface 12*b* of the first mounting portion 12. The receiving recessed portion 14 is provided on just the back side of the raised portion 17, and straddles from the cylindrical side portion 12*a* to the extending portion 12*e*. As shown in FIG. 10, the receiving recessed portion 14 in the cylindrical side portion 12*a* is continuous to the cutout portion 13 and further continuous to the inside of the first cylindrical portion 11. The receiving recessed portion 14 in the extending portion 12*e* reaches the end surface 17*e* on the side (the upper side in FIG. 10) of the raised portion 17 which is directing the axes line L.

As shown in FIG. 10, two (plural) fitting recesses 16A, 16B (regulating portions) are further formed in the first mounting portion 12. These fitting recesses 16A, 16B are provided in the receiving recessed portion 14 in the cylindrical side portion 12*a* and are arranged on just the back side of the raised portion 17. Each of the fitting recesses 16A and 16B extends along the plane perpendicular to the axis line L so that it deeply enters the inside of the raised portion 17 from the receiving recessed portion 14 and extends straight along with the width direction of the first mounting portion 12, namely in a radial direction (up and down in FIG. 10) of 1 of the first mounting member 10. Each end portion 16*c* of the fitting recesses 16A, 16B on the side (radially and inwardly, the upper side in FIG. 10) of the first cylindrical portion 11 penetrates a peripheral wall of the first cylindrical portion 11 and is continuous to the inside of the first cylindrical portion 11. Each end surface 16*d* of the fitting recesses 16A, 16B on the opposite side (the lower side in FIG. 10) to first cylindrical portion 11 is continuous to the end surface 14*d* of the receiving recess portion 14 on the opposite side (the lower side in FIG. 10) to the first cylindrical portion 11 in same plane.

Figure 5:
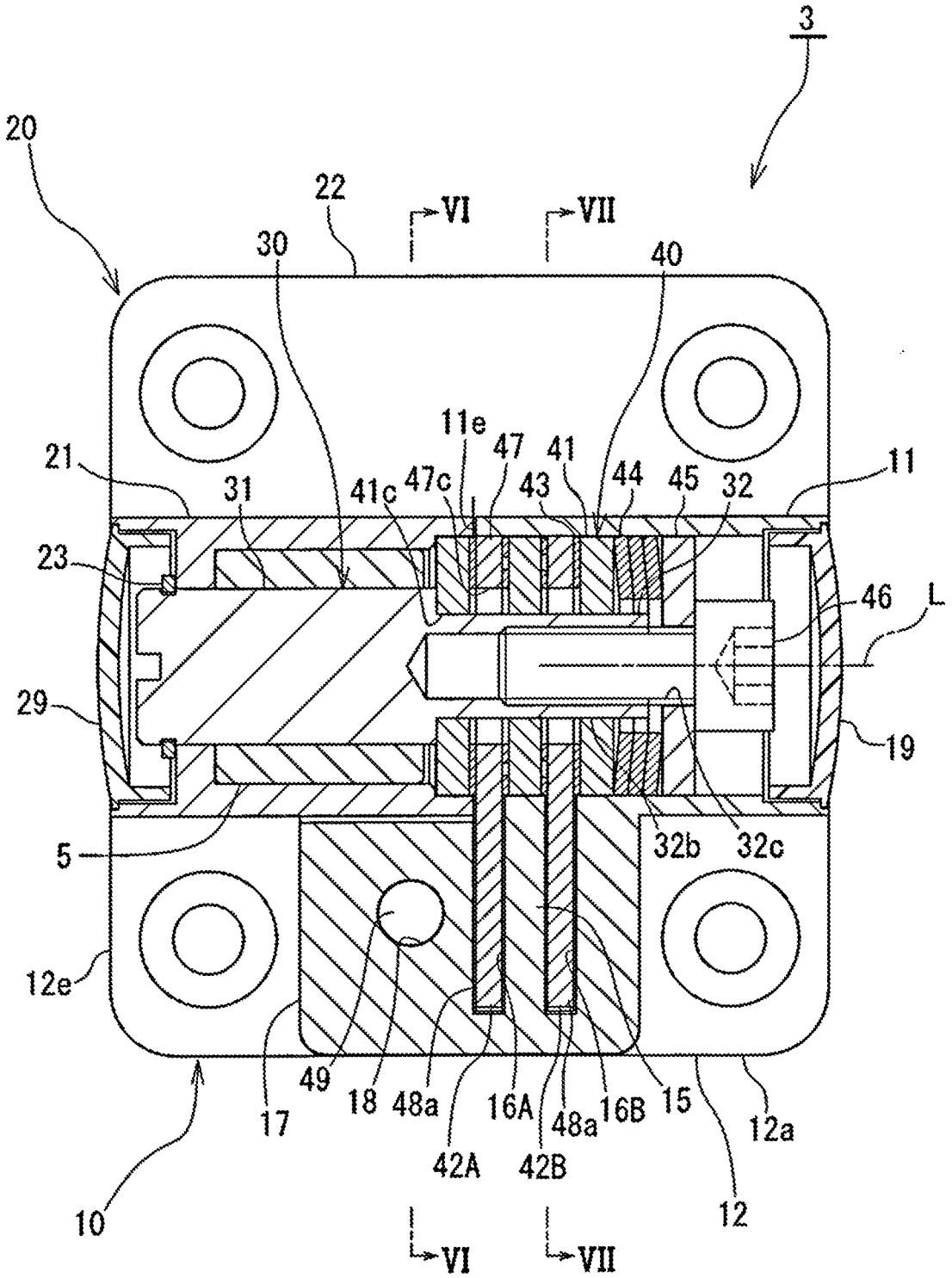
FIG. 5 is a cross-sectional view of a front surface of the hinge taken along a line V-V in FIG. 6.

As shown in FIG. 5 and FIG. 10, the two fitting recesses 16A, 16B are arranged in parallel along the axis line L (left and right in FIG. 5) and slightly apart from each other. The first fitting recess 16A is arranged on the side (the left side in FIG. 5, the right side in FIG. 10) close to the extending portion 12*e*. The second fitting recess 16B is arranged on the side farther from the extending portion 12*e* (the right side in FIG. 5, the left side in FIG. 10).

The side surface of the first fitting recess 16A on the side (the left side in FIG. 5, the right side in FIG. 10) of the extending portion 12*e* is arranged on substantially the same plane as the end surface 11*e* of the first cylindrical portion 11.

As shown in FIG. 10, the side surface of the second fitting recess 16B on opposite side (the left side in FIG. 10) to the first fitting recess 16A is continuous to the back edge 13*b* of the cutout portion 13 in the same plane.

As shown in FIG. 10, a partition wall 15 is formed between two fitting recesses 16A, 16B. The partition wall 15 has a flat plate shape along a plane perpendicular to the axis line L and extends straight along the width direction of the first mounting portion 12. The end portion 15*a* of the partition wall 15 on the side (radially inward, the upper side in FIG. 10) of the first cylindrical portion 11 faces the inside of the first cylindrical portion 11 to thereby constitute a part of a circumferential wall of the first cylindrical portion 11. A corner portion 15*e* between the edge portion on the back side (the front side in FIG. 10) of the partition wall 15 and the end portion 15*a* defines one end portion 13*a* of the cutout portion 13.

A female threaded hole 18 is formed in the receiving recessed portion 14 in the extending portion 12*e*. The female threaded hole 18 is arranged on the side (the right side in FIG. 10) of the second mounting member 20 than the fitting recess 16A.

Figure 4A:
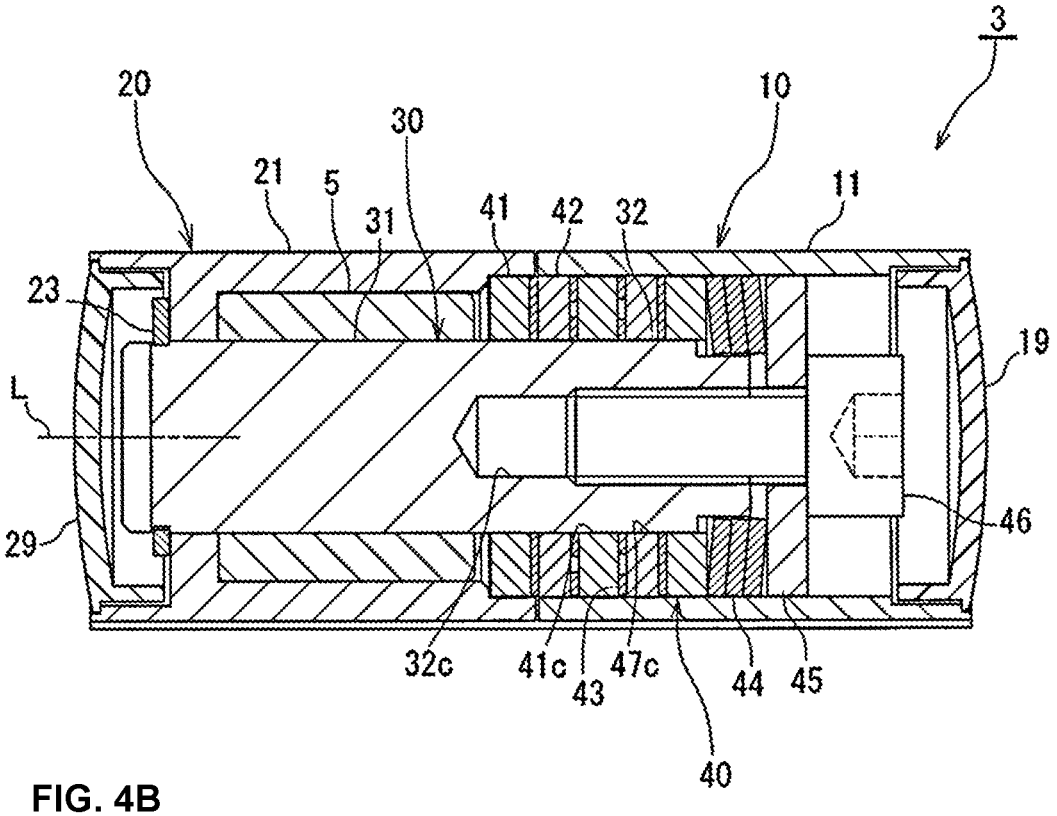
FIG. 4A is a cross-sectional view of a bottom surface of the hinge taken along a line IVa-IVa in FIG. 1A.

As shown in FIG. 4A and FIG. 5, the shaft member 30 has a cylindrical shaft portion 31 and a flattened shaft portion 32 and extends straight along the axis line L. The cylindrical shaft portion 31 is arranged on the side (the left side in FIG. 4A) of the second cylindrical portion 21, and the flattened shaft portion 32 is arranged on the side (the right side in FIG. 4A) of the first cylindrical portion 11.

Figure 6:
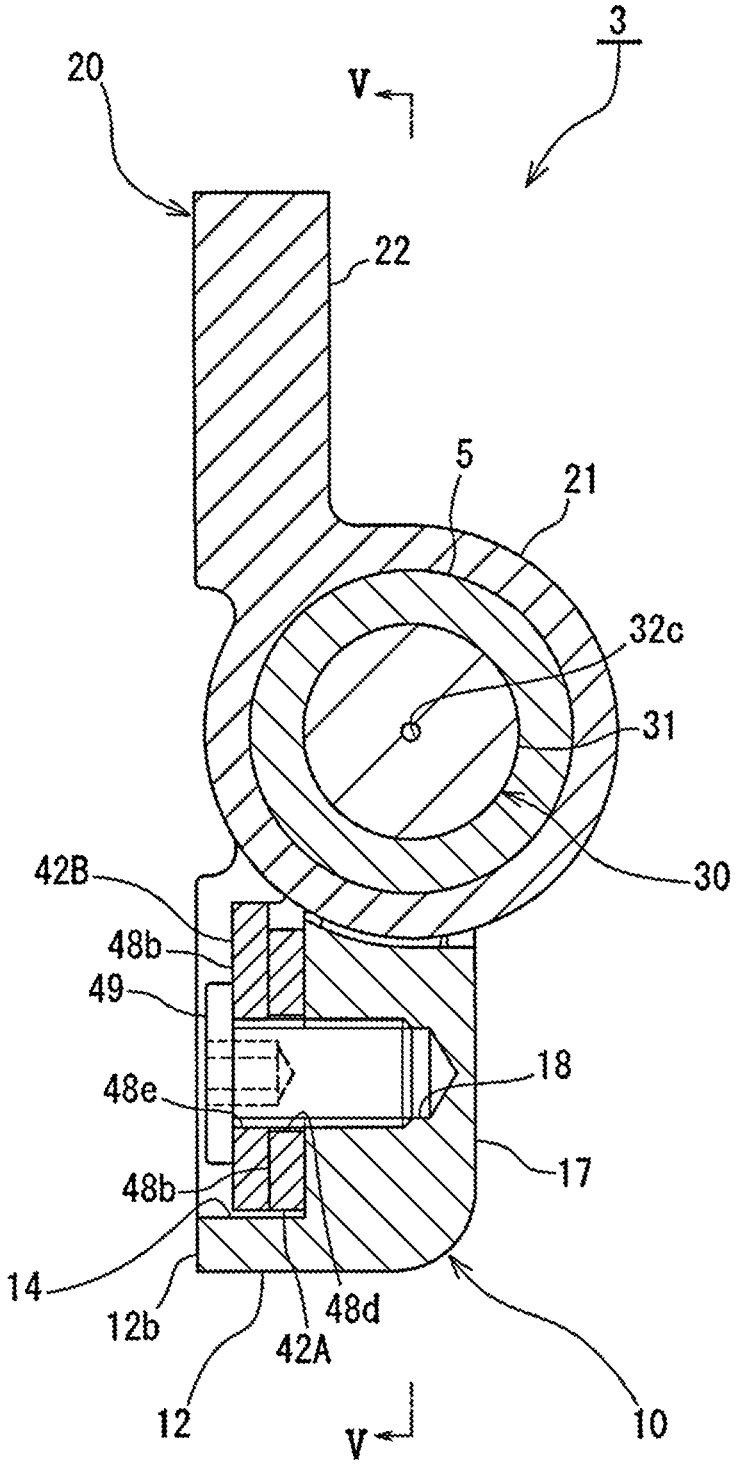
FIG. 6 is a cross-sectional view of a side surface of the hinge taken along a line VI-VI in FIG. 5.

As shown in FIG. 5 and FIG. 6, the cylindrical shaft portion 31 becomes a columnar shape having a perfect circular cross section. The cylindrical shaft portion 31 is received in the second cylindrical portion 21. An end portion on the outside (the left side in FIG. 5) in the axial direction of the cylindrical shaft portion. 31 is prevented from coming off by a snap ring 23.

As shown in FIG. 5 and FIG. 6, a cylindrical-shaped one-way unit 5 is provided between the inner circumference of the second cylindrical portion 21 and the outer circumference of the cylindrical shaft portion 31. The cylindrical shaft portion 31 is connected to the second mounting member 20 through the one-way unit 5. As a result, the shaft member 30 is connected to the rotational cover 2 (one member of the first and second members) through the one-way unit 5 and the second mounting member 20. When the rotational cover 2 rotates in an opening direction, the one-way unit 5 allows free rotation of the second mounting member 20 by preventing torque from being transmitted between the second mounting member 20 and the shaft member 30. On the other hand, when the rotational cover 2 rotates in a closing direction, the torque is transmitted between the second mounting member 20 and the shaft member 30 to prevent a relative rotation of the second mounting member 20 with respect to the shaft member 30.

As shown in FIG. 5 and FIG. 7, a pair of flattened portions 32*b*, 32*b* are formed on an outer peripheral portion of the flattened shaft portion 32. Each of the flattened portions 32*b* has a planar shape and extends over the entire length of the flattened shaft portion 32. The pair of flattened portions 32*b*. 32*b* is spaced apart from each other by 180 degrees in the circumferential direction. The sectional shape of the flattened shaft portion 32 becomes an oval shape or an oblong shape. A female threaded hole 32*c* is formed inside the flattened shaft portion 32. The female threaded hole 32*c* extends along the axis line L and reaches the end face on the outer side in the axial direction (the right side in FIG. 5) of the flattened shaft portion 32.

As shown in FIG. 5, the friction generating means 40 is provided on the outer circumference of the flattened shaft portion 32. As shown in FIG. 3, the friction generating means 40 includes one or a plurality (three in this case) of shaft side friction generating members 41, one or a plurality (two in this case) of cylindrical side friction generating members 42, one or a plurality (four in this case) of friction plates 43, one or a plurality (three in this case) of disc springs 44, a washer 45, and an adjustment member 46. The friction generating means 40 including these friction generating members 41, 42 and the like is accommodated inside the first cylindrical portion 11 together with the flattened shaft portion 32 (a part of the shaft member 30). Further, the friction generating members 41, 42 are brought into pressure-contact with each other, so that the rotational resistance is generated so that the rotational cover 2 can be held at an arbitrary opening angle.

As shown in FIG. 3, the shaft side friction generating members 41 are formed into an annular flat plate shape. A material of the shaft side friction generating members 41 is a metal such as stainless steel or steel. The center holes 41*c* of the shaft side friction generating members 41 become an oval shape or an oblong shape. As shown in FIG. 5, by inserting the flattened shaft portion 32 into the center holes 41*c*, the shaft side friction generating members 41 cannot rotate with respect to the shaft member 30.

As shown in FIG. 8A through FIG. 9C, the cylindrical side friction generating member 42 integrally includes a cylindrical side friction generating portion 47 and a connecting convex portion 48. A material of the cylindrical side friction generating member 42 is a metal such as stainless steel or steel.

The cylindrical side friction generating portion 47 is formed into an annular flat plate shape. The center hole 47*c* of the cylindrical side friction generating portion 47 becomes a perfect circle. As shown in FIG. 5 and FIG. 7, the flattened shaft portion 32 is inserted into the center hole 47*c*. The cylindrical side friction generating member 42 is relatively rotatable around the axis line L with respect to the shaft member 30.

Figure 8A:
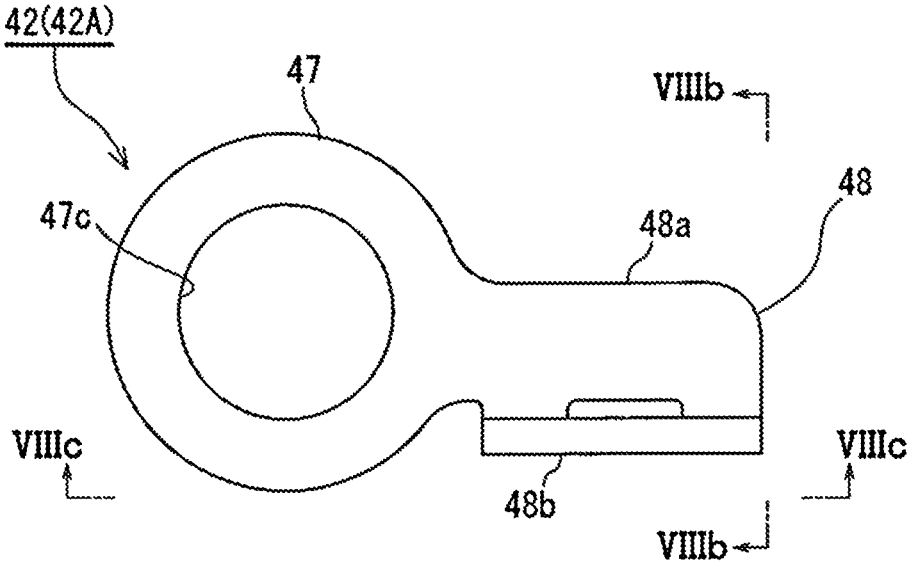
FIG. 8A is a side view of a first cylindrical side friction generating member of the hinge, which is viewed from a direction along the axial line.
Figure 8B:
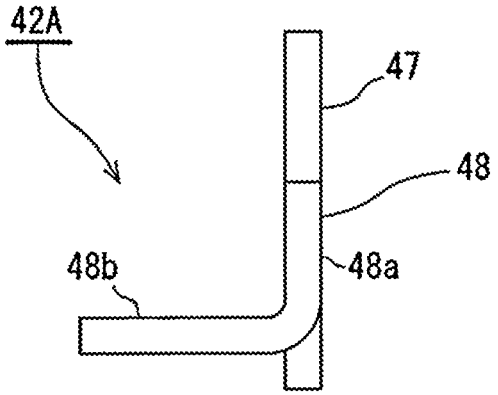
FIG. 8B is a front view of the first cylindrical side friction generating member, which is taken along a line VIIIb-VIIIb in FIG. 8A.
Figure 9A:
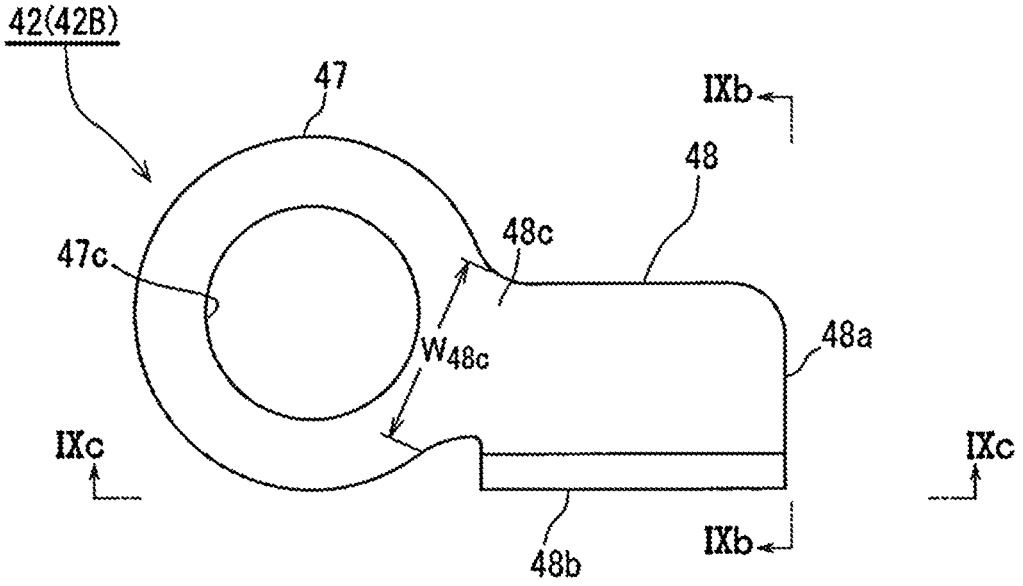
FIG. 9A is a side view of a second cylindrical side friction generating member of the hinge, which is viewed from a direction along the axial line.
Figure 9B:
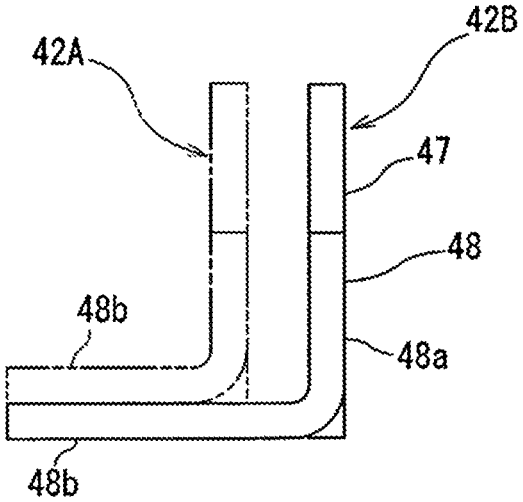
FIG. 9B is a front view of the second cylindrical side friction generating member, which is taken along a line IXb-IXb in FIG. 9A.

As shown in FIG. 8A and FIG. 9A, a coupling protruding portion 48 is provided on one side in the circumferential direction of the cylindrical side friction generating portion 47 of each cylindrical side friction generating member 42. The coupling protruding portion 48 protrudes from the cylindrical side friction generating portion 47 radially and outwardly. The coupling protruding portion 48 includes a protruding plate portion 48*a* and a fixed plate portion 48*b*, and becomes an L-shape. The protruding plate portion 48*a* becomes a rectangular flat plate shape extending straight from the cylindrical side friction generating portion 47. The longitudinal direction of the protruding plate portion 48*a* extends along the radial direction of 1 in the cylindrical side friction generating portion 47. The width direction of the protruding plate portion 48*a* is directed to the circumferential direction perpendicular to the above-described radial direction in the cylindrical side friction generating portion 47.

Figure 8C:
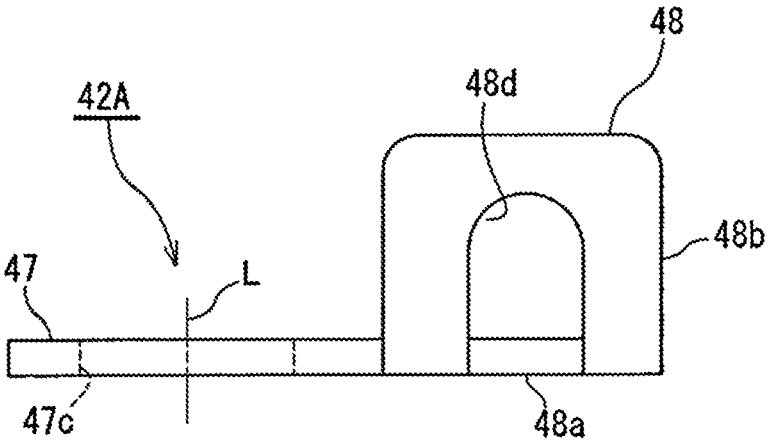
FIG. 8C is a bottom view of the first cylindrical side friction generating member, which is taken along a line VIIIc-VIIIc in FIG. 8A.
Figure 9C:
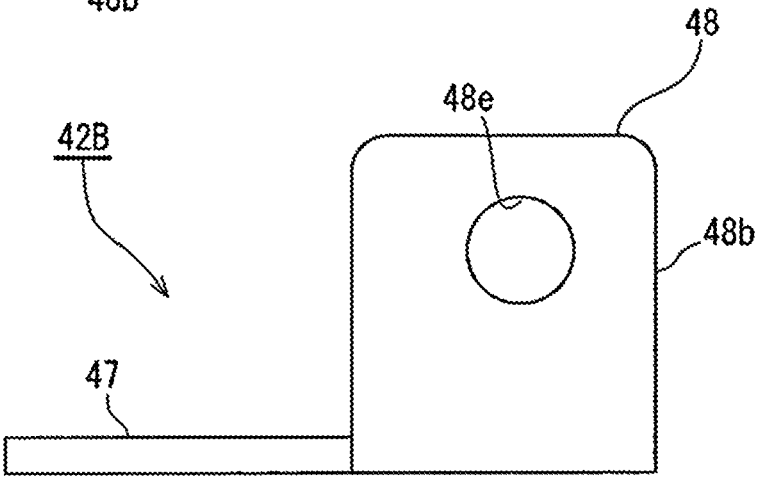
FIG. 9C is a bottom view of the second cylindrical side friction generating member, which is taken along a line IXc-IXc in FIG. 8A.

As shown in FIG. 8A and FIG. 9A, the fixed plate portion 48*b* is provided on an end edge of one side (the lower side in the same figure) in the width direction of the projecting plate portion 48*a* of each cylindrical side friction generating member 42. As shown in FIG. 8C and FIG. 9C, the fixed plate portion 48*h* becomes a quadrangular plate shape perpendicular to the width direction of the protruding plate portion 48*a*.

As shown in FIG. 3, the two cylindrical side friction generating members 42, 42 are arranged side by side along the axis line L. As shown in FIG. 8A through FIG. 9C, the coupling protruding portions 48, 48 of these two cylindrical side friction generating members 42, 42 are different from each other in a shape and size.

Hereinafter, when distinguishing these cylindrical side friction generating members 42 from each other, the reference numeral of the first cylindrical side friction generating member 42 arranged on the side (the left side in FIG. 3) close to the second cylindrical portion 21 is defined as "42A", and the reference numeral of the second cylindrical side friction generating member 42 arranged on the side (the right side in FIG. 3) far from the second cylindrical portion 21 is defined as "42B".

As shown in FIG. 8A through FIG. 9C, the width dimension (the dimension in a vertical direction in FIG. 9A) of the protruding plate portion 48*a* of the second cylindrical side friction generating member 42B is larger than the width dimension (the dimension in the vertical direction in FIG. 8A) of the protruding plate portion 48*a* of the first cylindrical side friction generating member 42A in the thickness of the cylindrical side friction generating member 42B. Therefore, as shown in FIG. 7, the width $W_{48c}$ of a continuous portion 48*c* of the cylindrical side friction generating portion 47 and the coupling protruding portion 48 in the second cylindrical side friction generating member 42B is larger than the width of the same part in the first cylindrical side friction generating member 42A (thin three-dotted chain line in the same figure).

Furthermore, the width $W_{48c}$ of the continuous portion 48*c* is slightly smaller than the width $W_{13}$ of the cutout portion 13 ($W_{13}>W_{48c}$). This difference ($W_{13}-W_{48c}$) becomes the minimum clearance in the circumferential direction around the axis line L when fitting the coupling protruding portion 48 of the second cylindrical side friction generating member 42B into the first mounting member 10.

As shown in FIG. 8C, an insertion hole 48*d* is formed in the fixed plate portion 48*b* of the first cylindrical side friction generating member 42A. The insertion hole 48*d* becomes an elongated hole shape. The major axis of the insertion hole 48*d* is oriented in a direction (up and down in the figure) parallel to the axis line L.

As shown in FIG. 9C, an insertion hole 48*e* is formed in the fixed plate portion 48*b* of the second cylindrical side friction generating member 42B. The insertion hole 48*e* becomes a perfect circle shape.

Figure 11A:
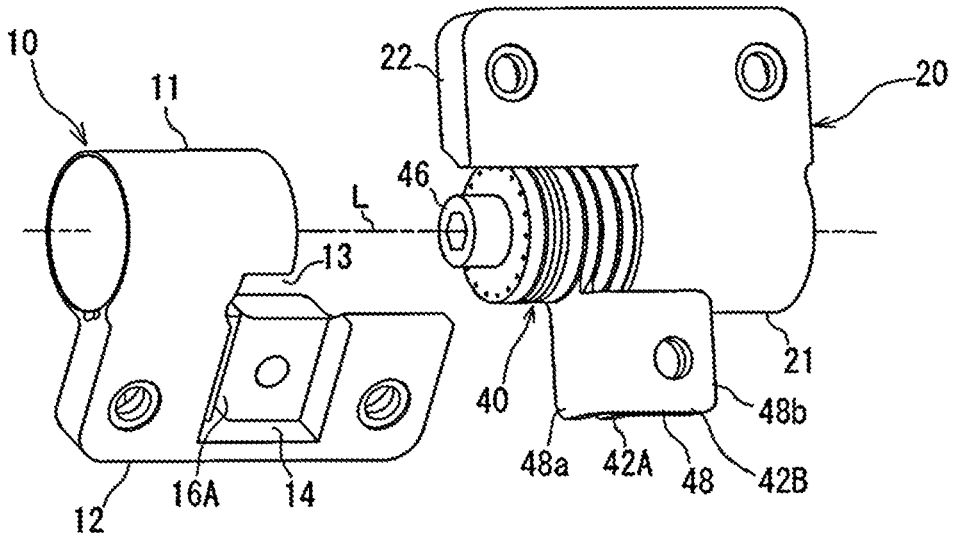
Figure 11B:
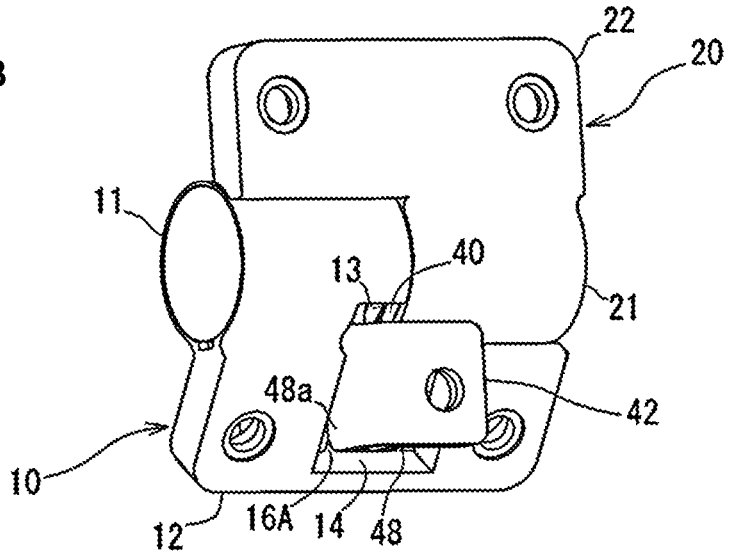

As shown in FIG. 11A to FIG. 11B, in the assembling stage of the hinge 3, the coupling protruding portion 48 of the cylindrical side friction generating member 42 can be inserted into and removed from the cutout portion 13 along the axis line L.

As shown by the two-dot chain line in FIG. 7, the coupling protruding portion 48 of the second cylindrical side friction generating member 42B is inclined with respect to the first mounting portion 12, whereby it is possible to be inserted into and removed from the side of the back end edge 13*b* of the cutout portion 13 from the partition wall 15 through between the end portion 13*e* of the cutout portion 13 and the corner portion 15*e* of the partition wall 15.

Figure 11C:
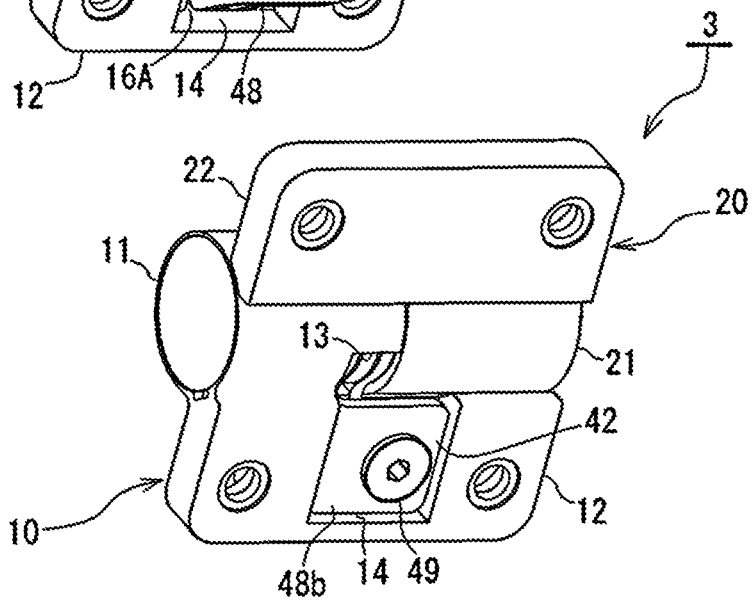
FIG. 11C is a perspective view which shows a state that the cylindrical side friction generating member is fixed to the first mounting member, or a state that the assembly is completed.

Further, as shown in FIG. 11B to FIG. 11C, the coupling protruding portion 48 becomes tilting or relatively rotatable around the axis line L with respect to the first mounting member 10 at a position inserted to the back side (the left side in figures) of the cutout portion 13. Along with this relative rotation, the protruding plate portions 48*a*, 48*a* of the coupling protruding portions 48, 48 of the cylindrical side friction generating members 42A, 42B can be inserted into and removed from the corresponding fitting recesses 16A, 16B, respectively.

Figure 4B:
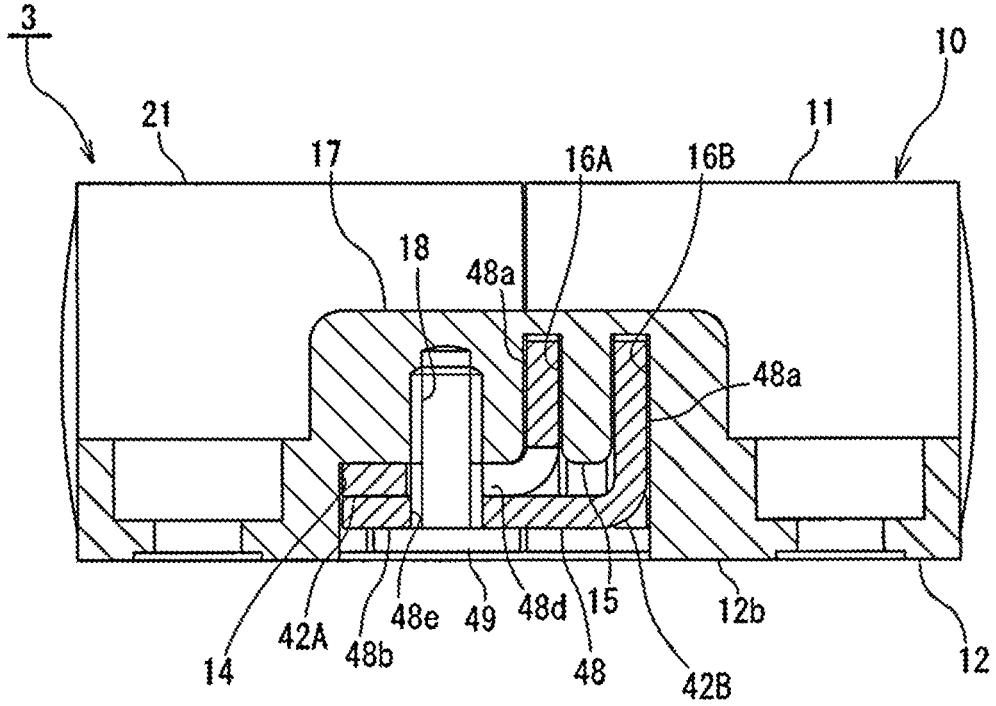
FIG. 4B is a cross-sectional view of a bottom surface of the hinge taken along a line IVb-Ivb in FIG. 1A.

As shown in FIG. 7, in the state that the hinge 3 is assembled, the coupling protruding portion 48 of the cylindrical side friction generating member 42 passes through the continuous end portion 16*c* in the fitting recesses 16A, 16B from the inside of the first mounting portion 11 and protrudes from the first mounting portion 1I radially and outwardly. As shown in FIG. 4B and FIG. 5, the protruding plate portion 48*a* of the first cylindrical side friction generating member 42A is fitted into the first fitting recess 16A (regulating portion). The protruding plate portion 48*a* of the second cylindrical side friction generating member 42B is fitted into the second fitting recess 16B (regulating portion). As a result, the coupling protruding portion 48 is restricted from moving along the axis line L with respect to the first cylindrical portion 11.

As shown in FIG. 6, in a state where the hinge 3 is further assembled, the fixed plate portion 48*b* of the cylindrical side friction generating member 42 is parallel to the first mounting portion 12. In addition, the fixed plate portions 48*b*, 48*b* of the two cylindrical side friction generating members 42A, 42B are overlapped with each other. More specifically, the fixed plate portion 48*b* of the cylindrical side friction generating member 42B is overlapped on the back side (the left side in FIG. 6) of the fixed plate portion 48*b* of the cylindrical side friction generating member 42A. These fixed plate portions 48*b*, 48*b* are received in the receiving recessed portion 14 in a superimposed state.

Further, the insertion holes 48*d*, 48*e* overlap with each other in the thickness direction (left and right in FIG. 6) of the fixed plate portion 48*b*. Through these insertion holes 48*d*, 48*e*, a fixing member 49 made of bolts is screwed into the female screw hole 18. As a result, the fixed plate portion 48*b*, and in turn the coupling protruding portion 48, are fixed to the first mounting portion 12 from the first cylindrical portion 11 radially and outwardly. As a result, the cylindrical side friction generating member 42 is fixed to the first mounting member 10 at a predetermined relative angle around the axis line L.

As shown in FIG. 4A, a plurality (three) of the shaft side friction generating members 41 and a plurality (two) of the cylindrical side friction generating members 42 are fitted to the flattened shaft portion 32 alternately along the axis line L. The annular friction plate 43 is interposed between the adjacent shaft side friction generating member 41 and the cylindrical side friction generating member 42. A material of the friction plate 43 is made of phosphor bronze or the like. Wear of the friction generating members 41, 42 can be prevented or suppressed by the friction plate 43.

A plurality (three) of disc springs 44 (biasing means) are provided on the end portion of the flattened shaft portion 32 on the side (the right side in FIG. 4A) opposite to the cylindrical shaft portion. The disc springs 44 become annular. Three disc springs 44 are stacked along the axis line L. Further, an adjustment member 46 made of bolt is screwed into the female screw hole 32*c* of the shaft member 30 through the center hole of the washer 45. The disc springs 44 are sandwiched by the shaft side friction generating member 41 on the end side (the right end side in FIG. 4A) and the washer 45 (pressing member). Furthermore, the disc springs 44 are compressed by the screwing-in of the adjustment member 46, so that the adjacent shaft side friction generating member 41 and the friction plate 43 and the adjacent friction plate 43 and the cylindrical side friction generating portion 47 are strongly pressed against each other. In other words, the shaft side friction generating member 41 and the cylindrical side friction generating portion 47 are indirectly pressure-contact with each other through the friction plate 43. As a result, when the cylindrical side friction generating member 42 tries to rotate relative to the shaft side friction generating member 41, the friction resistances develop between the cylindrical side friction generating member 42 and the friction plate 43 and/or between the friction plate 43 and the shaft side friction generating member 41.

The torque hinge 3 is assembled as follows.

First, as shown in FIG. 11A, the one-way unit 5 and the shaft member 30 are inserted into the second cylindrical portion 21 of the second mounting member 20. In addition, the friction generating means 40 is mounted on the flattened shaft portion 32 of the shaft member 30. By screwing the adjustment member 46 to the end portion of the flattened shaft portion 32, it is possible to prevent the friction generating means 40 from detaching from the flattened shaft portion 32. Further, the friction generating members 41, 42 are pressure-contact with each other through the friction plates 43 by the screwing force of the adjusting member 46 and/or the biasing force of the disc springs 44. Further, the relative angle between the cylindrical side friction generating members 42A, 42B is held at a predetermined angle, and the coupling protruding portions 48, 48 of the cylindrical side friction generating members 42A, 42B are held in a state that they are superimposed on each other.

Next, as shown in FIG. 11A to FIG. 11B, the flattened shaft portion 32 with the friction generating means 40 and the first mounting member 10 face each other on the same axis line L and approach each other, so that the flattened shaft portion 32 with the friction generating means 40 is inserted into the first cylindrical portion 11. At this time, since there is a sufficient clearance between the coupling protruding portion 48 and the cutout portion 13, if the coupling protruding portion 48 is angled to some extent with respect to the first mounting member 10, the coupling protruding portion 48 can be easily inserted into the cutout portion 13 without interfering with the first cylindrical portion 11 and the first mounting portion 12. It is not necessary to precisely adjust the angle of the coupling protruding portion 48 with respect to the first mounting member 10. Therefore, it is possible for assembly to be facilitated.

Next, as shown in FIG. 11C, by relatively rotating the second mounting member 20 and the first mounting member 10, the protruding plate portions 48*a*, 48*a* of the two cylindrical side friction generating members 42A, 42B are fitted in the fitting recesses 16A, 16B, respectively, and the fixed plate portions 48*b*, 48*b* are received in the receiving recessed portion 14. This restricts the movement of the protruding plate portions 48, 48 along the axis line L. Therefore, the friction generating means 40 can be prevented from coming out with respect to the first mounting member 10. As a result, it is possible to prevent the mounting members 10, 20 from coming apart.

Next, the fixing member 49 is passed through the insertion holes 48*d*, 48*e* and screwed into the female screw hole 18. By forming the insertion hole 48*d* into a long hole shape, even if there are manufacturing errors of the shaft side friction generating member 41 and the friction plates 43, etc., it is possible to reliably align the insertion holes 48*d*, 48*e* with each other and reliably insert the fixing member 49 into the insertion holes 48*d*, 48*e*. The fixed plate portions 48*b*, 48*b* are fixed to the first mounting portion 12 by screwing the fixing member 49 into the female screw hole 18. By screwing the protruding plate portions 48*a*, 48*a* into the fitting recesses 16A, 16B, it is possible to screw the fixing member 49 easily. Furthermore, the cylindrical side friction generating member 42 can be accurately positioned and fixed to the first mounting member 10.

In this way, the torque hinge 3 can be easily assembled.

By receiving the friction generating means 40 together with the shaft member 30 in the first cylindrical portion 11, the aesthetic appearance of the torque hinge 3 can be secured.

In the container apparatus M including the torque hinge 3, torque is not transmitted between the one-way unit 5 and the second mounting member 20 when the rotational cover 2 is opened. Therefore, it is possible to turn the rotational cover 2 with almost no resistance.

When closing the rotational cover 2, the torque is transmitted between the one-way unit 5 and the second mounting member 20, and the second mounting member 20 and the shaft member 30 become non-rotatable relative to each other. Therefore, the shaft member 30 tries to rotate with respect to the cylindrical side friction generating member 42, As a result, the frictional resistance acts between the cylindrical side friction generating member 42 and the friction plate 43 and/or between the friction plate 43 and the shaft side friction generating member 41. Due to this frictional resistance, it is possible to stop the rotational cover 2 at the arbitrary angle.

By fixing the cylindrical side friction generating member 42 and the first mounting member 10 with the fixing member 49, it is possible to prevent play from occurring when the rotational cover 2 is opened and closed. Therefore, it is possible to reliably stop the rotational cover 2 at the arbitrary angle.

By adjusting the screwing amount of the adjusting member 46, the magnitude of the frictional resistance can be increased or decreased.

By applying a closing direction torque equal to or more than the frictional resistance to the rotational cover 2, the rotational cover 2 can be closed.

The present invention is not limited to the above embodiments, and various modifications can be made as long as they do not depart from the gist of the invention.

For example, the cutout portion 13 may not necessarily be formed in the cylindrical portion 11 of the mounting member 10. The coupling protruding portion 48 protrudes to the outside of the cylindrical portion 11 from the opening of the end portion in the axial direction of the cylindrical portion 11 and protrudes from the cylindrical portion 11 radially and outwardly, so that it may be fixable with the mounting portion 12.

The cylindrical portion 11 and the mounting portion 12 of the mounting member 10 may be formed separately from each other, and then joined by screw fastening, welding, or the like.

The mounting member 20 may be omitted. The cylindrical shaft portion 31 of the shaft member 30 may be directly connected to the rotational cover 2 (one of the first and second members).

The coupling protruding portion 48 may be fixed to the mounting portion 22 by being sandwiched between the mounting portion 22 and the housing 1 (the other of the first and second members). The fixing member 49 may be omitted.

The biasing means such as the disc springs 44 may be omitted. The frictional force may be generated between the friction generating members 41, 42 only by tightening the adjusting member 46.

The number of the shaft side friction generating members 41 is not limited to three, and may be one, two, or four or more. The number of the cylindrical side friction generating members 42 is not limited to two, and may be one, three or more. The number of the cylindrical side friction generating members 42 may be larger than the number of the shaft side friction generating members 41. The number of the cylindrical side friction generating members 42 may be the same as the number of the shaft side friction generating members 41.

The friction generating members 41, 42 may be pressure-contact with each other directly through no friction plates 43. The friction plates 43 may be omitted.

The mounting member 10 may be fixed to the housing 1 (the first member), and the mounting member 20 may be fixed to the rotational cover 2 (the second member).

The one-way unit 5 may be omitted. The frictional resistance by the friction generating means 40 may be exerted both when the rotational cover 2 is opened and when it is closed. The frictional resistance caused by the friction generating means 40 is exerted when the rotational cover 2 is opened, and the frictional resistance may not be exerted when it is closed.

The second member may be a door. The axis line L is not limited to be horizontal but may be vertical or diagonal.

The object to which the hinge 3 is applied is not limited to the container apparatus M, and it may be a laptop computer or the like.

The present invention is applicable to, for example, a rotational cover of a container device or a hinge of a door.

What is claimed is:

1. A hinge for rotatably coupling a second member with respect to a first member around an axial line thereof, the hinge comprising:

a shaft member coupled with one of the first and second members;

a mounting member which includes a cylindrical portion provided coaxially with the shaft member and a mounting portion which protrudes from the cylindrical portion radially and outwardly and fixed to an other of the first and second members;

a shaft side friction generating member which is provided on the shaft member so as not to be rotatable with respect to the shaft member; and a cylindrical side friction generating member which includes a cylindrical side friction generating portion provided on the shaft member in a relatively rotatable manner and a coupling protruding portion which protrudes from the cylindrical side friction generating portion radially and outwardly, wherein the shaft side friction generating member and the cylindrical side friction generating member are contained in the cylindrical portion in such a state that they are frictionally in contact in an axial direction of the shaft member with each other together with a part of the shaft member, and wherein the coupling protruding portion protrudes from the cylindrical portion radially and outwardly and is fixed with the mounting portion;

wherein at a side part of the cylindrical portion in a circumferential direction thereof, there is formed a cutout portion into and from which the coupling protruding portion can be inserted and removed in a direction along the axial line;

wherein the mounting portion includes a fitting recess which is continuous to the cutout portion so as to extend toward a radial direction, and when the cylindrical side friction generating portion is relatively rotated with respect to the cylindrical portion during an assembly process in a contained state in the cylindrical portion, the coupling protruding portion is capable of being inserted into and removed from the fitting recess.

2. The hinge as claimed in claim 1, wherein a receiving recessed portion is formed in a surface of the mounting portion which abuts with the other of the first and second members, and the fitting recess is formed in the receiving recessed portion, wherein the coupling protruding portion includes a protruding plate portion which protrudes from the cylindrical side friction generating portion radially and outwardly, and a fixed plate portion which protrudes from the protruding plate portion along the axial line, and wherein the protruding plate portion is received into the fitting recess, and the fixed plate portion is received into the receiving recessed portion and fixed to the mounting portion.

3. The hinge as claimed in claim 1, further comprising a fixing member for fixing the coupling protruding portion and the mounting portion.

4. The hinge as claimed in claim 2, further comprising a fixing member for fixing the coupling protruding portion and the mounting portion.

* * * * *